United States Patent [19]

Vasas

[11] Patent Number: 4,527,575

[45] **Date of Patent: * Jul. 9, 1985**

[54] CONTOURED FLOCKED COSMETICS BRUSH FLEXERS

[75] Inventor: Martin M. Vasas, Fairfield, Conn.

[73] Assignee: The Bridgeport Metal Goods Manufacturing Co., Bridgeport, Conn.

[ * ] Notice: The portion of the term of this patent subsequent to Sep. 20, 2000 has been disclaimed.

[21] Appl. No.: 533,784

[22] Filed: Sep. 19, 1983

Related U.S. Application Data

[63] Continuation-in-part of Ser. No. 301,636, Sep. 14, 1981, Pat. No. 4,404,977.

[51] Int. Cl.[3] ..... A45D 40/26

[52] U.S. Cl. ..... 132/88.7

[58] Field of Search ..... 132/88.7, 88.5

[56] References Cited

U.S. PATENT DOCUMENTS

| | | | |
|---|---|---|---|
| 3,662,769 | 5/1972 | Vassas | 132/88.7 |
| 3,892,248 | 7/1975 | Kingsford | 132/88.7 |
| 3,896,823 | 7/1975 | Spatz | 132/88.7 |
| 3,998,235 | 12/1976 | Kingsford | 132/88.7 |
| 4,194,848 | 3/1980 | Kingsford | 132/88.7 |
| 4,403,624 | 9/1983 | Montgomery | 132/88.7 |
| 4,403,977 | 9/1983 | Vasas | 132/88.7 |
| 4,411,282 | 10/1983 | Wavering | 132/88.5 |

*Primary Examiner*—Gregory E. McNeill

*Attorney, Agent, or Firm*—Cifelli, Frederick & Tully

[57] ABSTRACT

A cosmetics applicator brush includes a ribbed flexer at the distal portion of the rod. Bristles extend outwardly from the flexer, some of the bristles being supported on the ribs and some being supported in grooves between the ribs. When the brush is loaded with cosmetics and drawn through a wiper diaphragm of the cosmetics container, the bristles on the larger diameter ribs are wiped relatively clean and the bristles in the grooves are subjected to less or no wiping action and carry a substantial amount of cosmetics for application. The relatively clean bristles extending from the ribs provide good combing action of the applied cosmetics. The ribs of a particular flexer may be differently sized, shaped, or offset in order to provide flexers having a wide variety of contours. In some flexers, the ribs define a longitudinal notch mounting a foam pad for extra cosmetics carrying capability.

25 Claims, 22 Drawing Figures

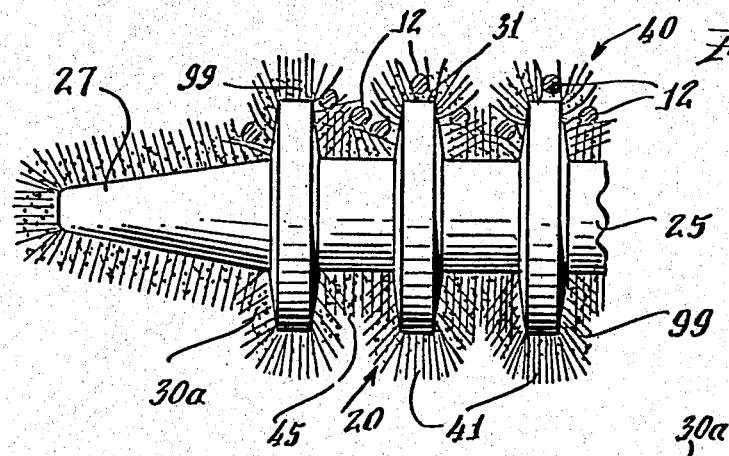
Fig. 5.
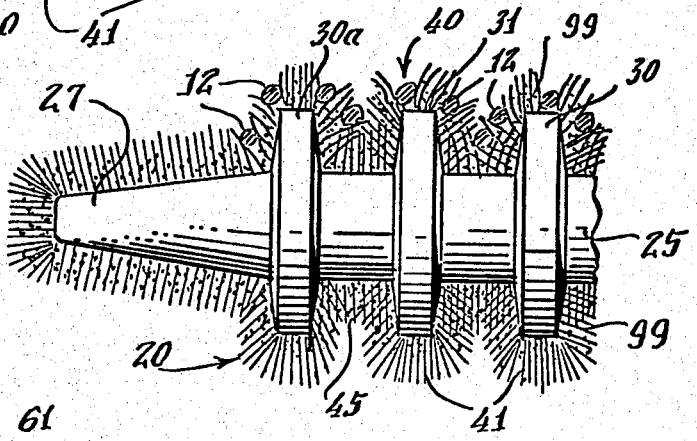
Fig. 6.
Fig. 7.
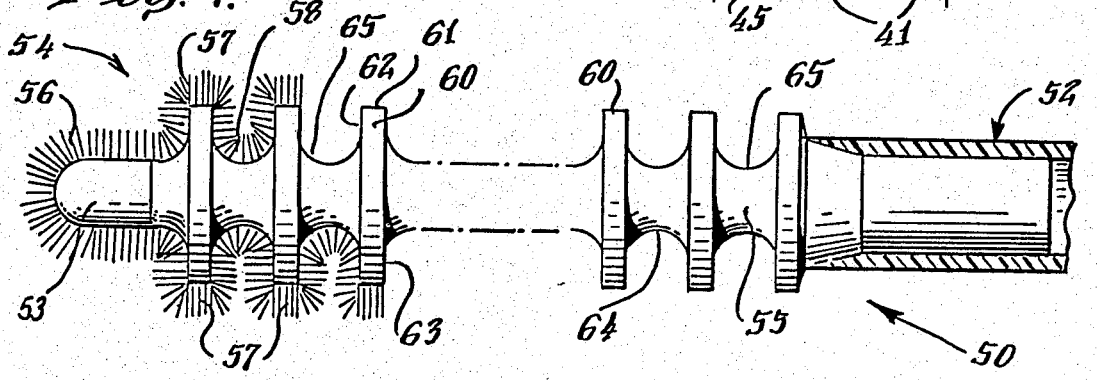
Fig. 8.
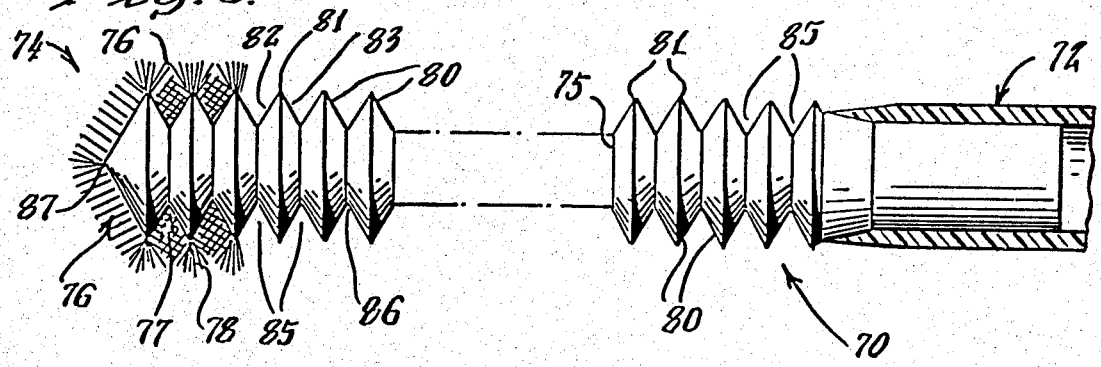

Fig. 9.
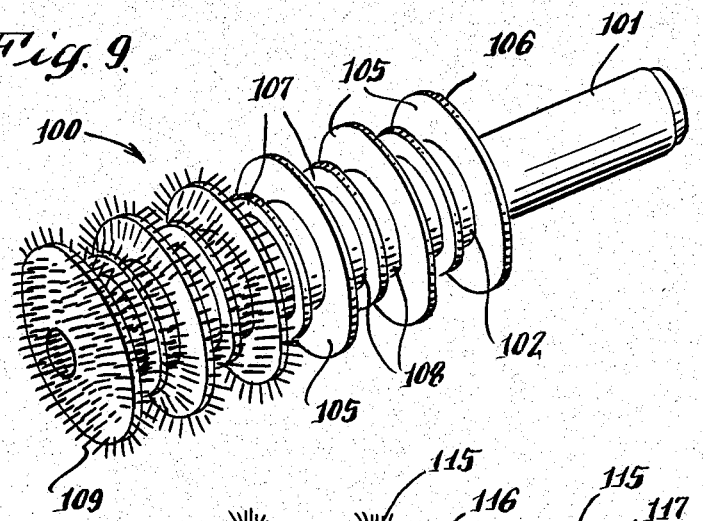
Fig. 10.
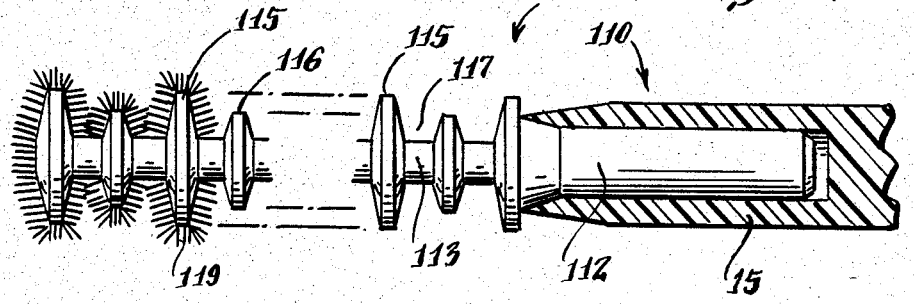
Fig. 11.
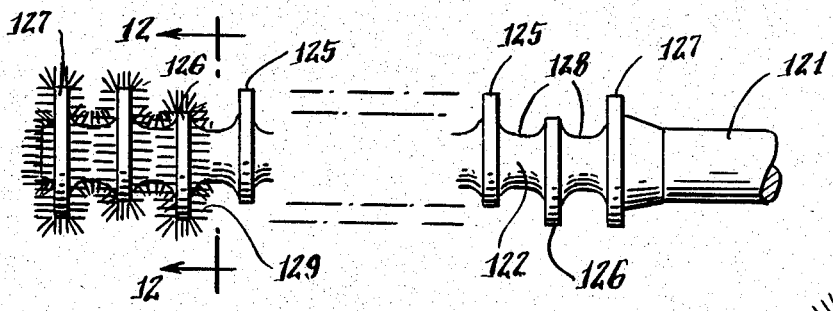
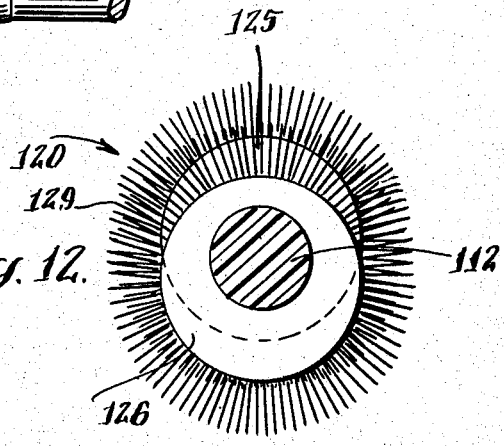
Fig. 12.
Fig. 13.
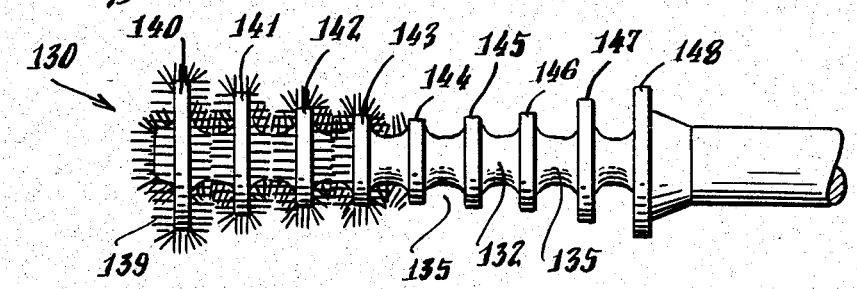

CONTOURED FLOCKED COSMETICS BRUSH FLEXERS

BACKGROUND OF THE INVENTION

This application is a continuation-in-part of my copending application Ser. No. 301,636 filed Sept. 14, 1981, issued as U.S. Pat. No. 4,404,977.

This invention relates to a cosmetics applicator brush and more particularly to a cosmetics applicator brush having a ribbed flexer with flocked bristles deployed thereon, whereby the cosmetics applicator brush is configured to achieve both substantial product carrying capability and good combining action. Contouring of the rib profile, including varying the size of individual ribs and/or offsetting them, adapts the brushes for specific purposes.

Several cosmetics products, particularly mascara for enhancing the appearance of eyelashes, are best applied with brush type applicators. An overall package for the cosmetics is generally provided, including a container, a cap for the container, and an applicator brush affixed to the cap of the container. The brush extends into the container to pick up the cosmetics for use and also to store the brush between uses. A wiper is provided at the mouth of the container, the wiper generally comprising a flexible diaphragm with a central aperture through which the brush is inserted and withdrawn from the container. The wiper removes excess cosmetics from the applicator brush as the applicator brush is removed from the container, i.e. the wiper controls the amount of cosmetics remaining on the brush upon removal of the brush from the container for applying the cosmetics. The flexible diaphragm also often provides a seal with the stem of the brush.

The prior art applicator brushes are generally of a twisted wire stem construction, with bristles being mounted by being captured in the twisted wire stem and extending radially outwardly therefrom. By virtue of this manufacturing technique, the bristles are generally arrayed in a spiral pattern about the axis of the wire stem, with the outer ends of the bristles together defining either a cylindrical or conical or even other non-symmetrical configuration. In one brush, the bristles are cut in a non-symmetrical configuration, i.e. they extend to different lengths along different radial directions from the stem, the bristles having a generally triangular configuration when viewed in cross section with the stem being asymmetrically positioned with respect to the triangular shape. Another mascara applicator has no bristles, being comprised of a screw-threaded end portion, and is used with mascara having fiber fillers.

A cosmetics applicator brush must accomplish two functions, namely applying the cosmetics, e.g. mascara to eyelashes, and also combing the eyelashes to spread the mascara, align the eyelashes and maximize their length. The prior art applicator brushes represent a compromise between their ability to carry mascara for application and their ability to comb the eyelashes. More particularly, the wiping action of the flexible diaphragm must remove a substantial amount of the mascara in order to avoid sloppy application and permit the desired combing action, but when the wiper and applicator brush are cooperatively designed to remove sufficient mascara to permit good combing, the applicator brush often carries insufficient mascara for efficient application. The prior art mascara applicator brushes are particularly ineffective when used with very low viscosity mascara products or with thick, high viscosity mascara products.

Other prior art brushes include a brush comprised of a straight stem with very soft flocked bristles attached to the distal portion thereof and used for applying eye shadow, i.e. the brush applies and spreads the product on a relatively smooth surface and has no combing function. Additionally, toothbrush type applicators have been made, but these are primarily for use with harder cosmetics preparations which do not require a wiper-equipped container.

Accordingly, there is a need in the art for a cosmetics applicator brush which better performs the combined functions of applying the cosmetics and combing.

SUMMARY OF THE INVENTION

A cosmetics applicator brush for mascara or other cosmetics, according to the invention herein, comprises a rod having a ribbed flexer at the end thereof, and bristles secured to the ribbed flexer. The bristles are deployed from the ribs of the flexer and from the grooves defined between the ribs and core of the flexer, wherein the outer ends of the bristles are at varying distances from the longitudinal axis of the flexer. In the preferred embodiments, the flexer is provided with a plurality of ribs spaced apart along its core, with the ribs extending radially outwardly, wherein the grooves defined between the ribs are circumferential about the flexer core between the ribs. However, a single spiral rib and other rib deployments are also within the scope of the invention. Spacing between the ribs, the configuration of the ribs and grooves, and the size and length of the bristles are selectable to achieve the best results in combination with various cosmetics products and with anticipated personal preferences of the user, all of which may vary.

The outer diameter of the ribs is preferably greater than the diameter of the opening in the wiper diaphragm used with the applicator brush to provide vigorous wiping action on the bristles extending from the ribs of the flexer, and the diameter of the flexer core (and the grooves) is of course smaller whereby the wiper diaphragm provides little or no wiping action on the bristles deployed in the grooves between the ribs of the flexer. Thus, the bristles in the grooves carry a substantial amount of mascara for application to the user's eyelashes, and the bristles extending from the ribs are wiped relatively clean for use in spreading the mascara and combing the eyelashes.

The flexer may also be provided with a small diameter tip having bristles extending therefrom, which is useful for applying the mascara in tight spaces and for touching up mascara.

The flexer may also be contoured to achieve certain application objectives. The shaping or contouring of the flexer is accomplished by varying the size of individual ribs, or by varying their axial deployment. For instance, a flexer having enhanced combing and separating functions has ribs of alternate larger and smaller diameters, or has ribs of similar diameter which are axially offset from each other to derive a stepped profile. Concave or convex flexer profiles are achieved by incrementally altering the diameter of adjacent ribs. An arched flexer profile has incrementally axially offset ribs, and uniformly axially offset ribs can be utilized to provide an asymmetric comb-like flexer. The ribs themselves can be of contoured, non-round shapes, for further design flexibility. A flexer of contoured individual ribs mounts a foam pad on one longitudinal portion, for increased product carrying capability. The foam pad, of course, carries no bristles, although the remaining portion of the flexer does so.

Accordingly, it is a principal object of the invention herein to provide an improved cosmetics applicator brush.

It is an additional object of the invention herein to provide an improved cosmetics applicator brush which is well adapted to applying mascara.

It is a further object of the invention herein to provide a cosmetics applicator brush which can carry a substantial amount of cosmetics and yet provides good combing action.

It is another object of the invention herein to provide improved cosmetics applicator brushes with contoured profiles for certain applications objectives.

It is a still further object of the invention herein to provide a cosmetics applicator brush which carries a supply of cosmetics in a storage pad portion.

Other and more specific objects and features of the invention herein will in part be obvious and will in part appear from a perusal of the following description of the preferred embodiments and claims, taken together with the drawings.

DRAWINGS

FIG. 5 is a side elevation view of the cosmetics applicator brush of FIG. 1 shown applying cosmetics to eyelashes;

FIG. 6 is a side elevation view of the cosmetics applicator brush of FIG. 1 shown combing eyelashes;

FIG. 7 is a side elevation view of another cosmetics applicator brush according to the invention herein;

FIG. 8 is a side elevation view of another cosmetics applicator brush according to the invention herein.

FIG. 9 is a perspective view of high-low profile flocked flexer for a cosmetics applicator brush according to the invention herein;

FIG. 10 is a side elevation view of another high-low profile flocked flexer for a cosmetics applicator brush according to the invention herein;

FIG. 11 is a side elevation view of a stepped flocked flexer for a cosmetics applicator brush according to the invention herein.

FIG. 12 is a sectional view of the stepped flocked flexer of FIG. 11, taken along the lines 12—12 of FIG. 11;

FIG. 13 is a side elevation view of a concave contoured flocked flexer for a cosmetics applicator brush according to the invention herein;

The same reference numerals refer to the same elements throughout the various Figures.

DESCRIPTION OF PREFERRED EMBODIMENTS

FIGS. 1-6 illustrate a cosmetics applicator brush 10 according to the invention herein. Although the cosmetics applicator brushes according to the invention herein are useful in applying many kinds of cosmetics, they are especially well adapted for applying mascara to eyelashes and will be described in relation to that use. The applicator brush 10 is used in conjunction with a container 90 for the mascara, the container 90 including a cap 95 to which the applicator brush is mounted.

Figure 1:
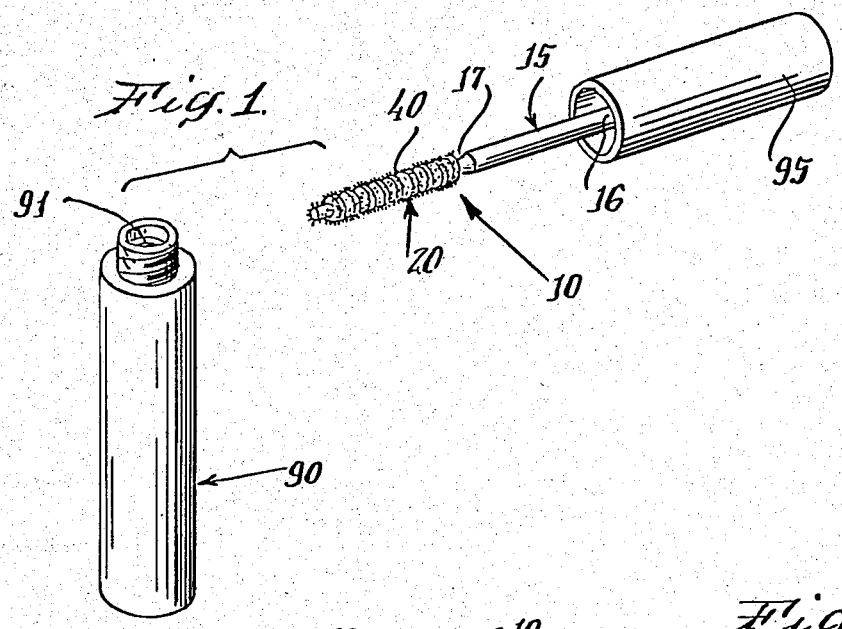
FIG. 1 is a perspective view of a cosmetics applicator brush according to the invention herein and a cosmetics container with which it is used.
Figure 2:
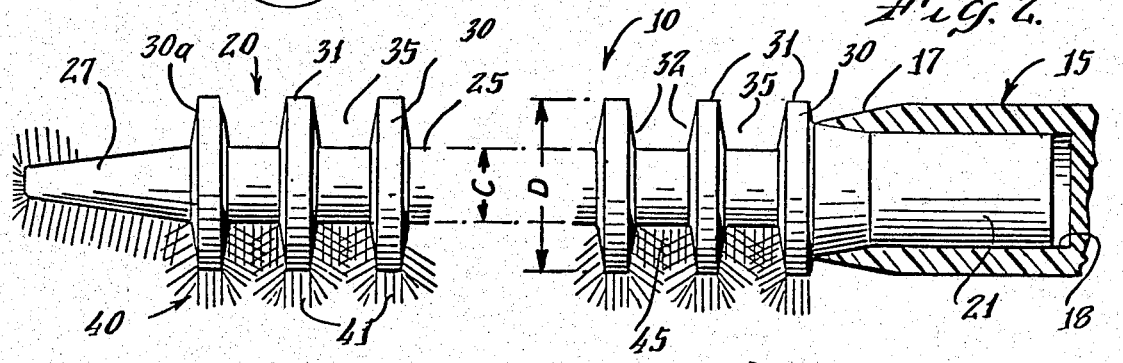
FIG. 2 is a side elevation view, partially cut away, of the cosmetics applicator brush of FIG. 1.

The cosmetics applicator brush 10 generally comprises a rod 15, a ribbed flexer 20 at one end of the rod 15 and bristles 40 secured to and extending outwardly from the flexer. With reference to FIG. 2, the applicator brush 10 is shown in more detail. The rod 15 is cylindrical and has its end 16 mounted to the cap 95 of container 90, as is well known in the art. The opposite end 17 of the rod 15 has a cavity 18 formed therein for mounting the flexer 20. The flexer 20 is mounted extending from the rod 15 opposite the cap 95 via a stem received in the opening 18 of the rod, and secured therein by staking, gluing, solvent or sonic welding. The flexer 20 further generally comprises a cylindrical core 25 terminating in a tip 27, and a plurality of ribs 30 extending outwardly from core 25 at spaced apart intervals. The core 25 has a diameter C.

The ribs 30 are each in the form of an annular disc, having outer cylindrical surfaces 31. The sides of the ribs, indicated at 32, may be slightly beveled. The plane of each of the ribs 30 is disposed perpendicularly to the axis of the flexer core 25, and the diameter D of the ribs 30 may be two to three times larger than the diameter C of core 25. The diameter of rod 15 may be about the same as the diameter of the ribs, and the end 17 of the rod 15 may be tapered so that the rib adjacent to it has some height relative to the rod. The ribs extend radially outwardly from the core 25 at spaced apart intervals, and therefore a plurality of annular grooves 35 are defined between adjacent ribs and the core 25 of the flexer. The core 25 extends beyond the outermost rib **30*a* to form a tip 27**, which is preferably tapered although not to a sharp point.

The rod 15 is fabricated of a relatively rigid plastic, e.g. DuPont's Delrin ® of the acetol family. The flexer 20 is preferably also formed of molded plastic, such as a polyurethane or polyvinylchloride. The flexer 20 is preferably somewhat flexible, this being accomplished both by choice of materials and because the diameter C of the core 25 is smaller than the diameter of the rod 15. In the preferred embodiment illustrated, the diameter C of the flexer core 25 is approximately 0.06 inch and the diameter D of the ribs 30 is approximately 0.16 inch. The ribs may be approximately 0.02 inch thick and are spaced apart approximately 0.05 inch. The flexer is approximately 1 inch long, and may include approximately ten ribs and the tip within that length.

The cosmetics applicator brush 10 further includes bristles 40. The numeral 40 refers to the bristles as a group, although specific portions of the bristles will be referred to by additional numbers. The length and denier of the bristles are selected in view of the characteristics of the cosmetics product to be applied by the brush, and in the preferred embodiment 10, bristles are 0.080 inch long, 30 denier nylon bristles. The bristles 40 are applied to the flexer 20 by a flocking process, in which a glue is applied to the flexer, and the bristles are electrostatically charged and applied to the flexer via an electrical field. By virtue of this process, the bristles are positioned generally perpendicularly on the outer cylindrical surfaces 31 of the ribs 30 and on the flexer core 25 between the ribs 30, i.e. in the base of the grooves 35, with some bristles being also attached to the sidewalls 32 of the ribs. Bristles are also applied in this manner to the tip 27 of the flexer. This results in a "layering" of the bristles, i.e. the bristles 41 attached to the outer cylindrical surfaces 31 of the ribs 30 protrude outwardly beyond the bristles 45 attached to the flexer core 25 in the grooves 35 between the ribs.

Figure 3:
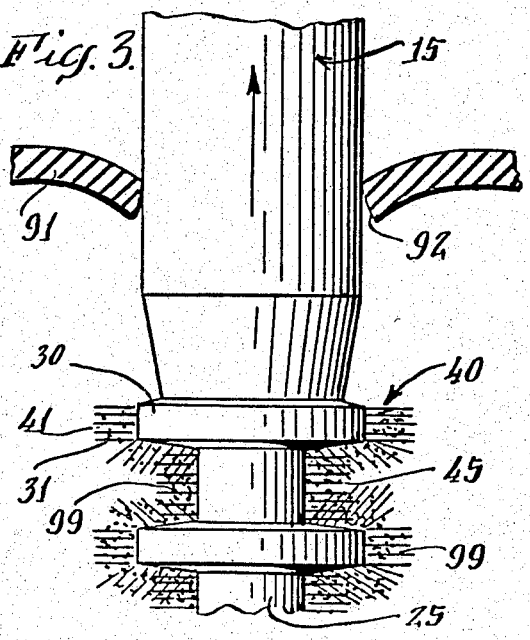
FIG. 3 is a side elevation view, partially cut away, of the cosmetics applicator brush of FIG. 1 shown inserted in the cosmetics container, also shown partially cut away.
Figure 4:
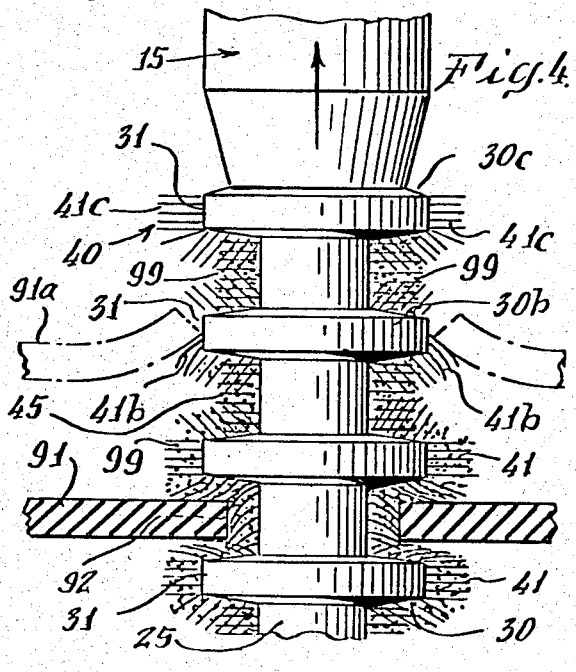
FIG. 4 is a side elevation view, partially cut away, of the cosmetics applicator brush of FIG. 1, shown being withdrawn from the cosmetics container, also shown partially cut away.

With reference to FIGS. 3 and 4, the loading of mascara 99 onto the cosmetics applicator brush 10 is illustrated. As noted above, the cosmetics container 90 includes a flexible wiper diaphragm 91 disposed across the entrance/exit passage to the container, and the wiper diaphragm 91 defines a central aperture 92 through which the cosmetics applicator brush passes when being inserted or withdrawn from the container 90. One of the functions of the wiper diaphragm 91 may be to provide a seal preventing escape of cosmetics from the container when the applicator brush is inserted therein, and in the embodiment shown the diameter of the aperture 92 is smaller than the diameter of rod 15 of the applicator brush, whereby the diaphragm is somewhat stretched about the rod and seals to the rod as is illustrated in FIG. 3. The flexer 20 and its bristles 40 are positioned within the cosmetics container 90 in FIG. 3, and mascara 99 is deposited and collected on the bristles 40. The principal function of the wiper diaphragm 91 is to remove excess mascara from the cosmetics applicator brush 10 as it is withdrawn from the cosmetics container 90 for use, and the action of wiper diaphragm 91 with respect to cosmetics applicator brush 10 is illustrated in FIG. 4. The wiper diaphragm is shown once in dotted lines 91*a* in FIG. 4 and once in solid lines 91, to illustrate the progressive action of wiper diaphragm as the applicator brush is withdrawn through the aperture 92 thereof. Referring first to the action of the wiper diaphragm as shown in dotted lines 91*a*, the wiper diaphragm is stretched over one of the ribs 30*b*, and vigorously wiping the bristles 41*b* extending from the outer surface 31 of the rib. Thus, the bristles 41*c* extending from a rib 30*c* which has passed through the wiper diaphragm, are wiped relatively clean of mascara. With reference to the action of the wiper diaphragm 91 as shown in solid lines in FIG. 4, the wiper diaphragm extends into one of the grooves 35 between the ribs 30 and wipes only the tips of the bristles 45 therein, wherein a substantial amount of mascara 99 remains entrained by the bristles 45. The condition "after wiping" can be seen between the upper two ribs 30*b* and 30*c* in FIG. 4. A substantial amount of mascara also remains on the bristles extending from the tip 27 of the applicator brush 10.

The operation of the applicator brush 10 in applying the mascara 99 to eyelashes 12 is illustrated in FIGS. 5 and 6. Referring first to FIG. 5, the applicator brush may be stroked firmly under eyelashes 12, forcing the eyelashes downwardly into the grooves 35 where the bristles 45 are carrying substantial amounts of mascara 99 as described above. As the applicator brush is stroked through the eyelashes 12, a transfer of mascara from the bristles 40 (i.e. primarily from the heavily loaded bristles 45 but also from the cleaner bristles 41) to the eyelashes 12 occurs. Referring next to FIG. 6, the brush may be drawn lightly through the eyelashes 12, wherein the relatively clean bristles 41 extending from the outer cylindrical surfaces of the ribs 30 spread the mascara over the eyelashes, align the eyelashes generally parallel to each other and comb the eyelashes to their maximum length, all in the manner desired for best appearance. The tip 27 may be used for "touch-up", as desired. Thus, the cosmetics applicator brush 10 is capable of carrying a substantial amount of mascara from the container and applying it to the eyelashes, and is also capable of spreading the mascara product and combing the eyelashes with relatively clean bristles.

A second cosmetics applicator brush 50 according to the invention herein is illustrated in FIG. 7. The applicator brush 50 also generally comprises a rod 52 mounting a ribbed flexer 54 having bristles 56 applied thereto. As is perhaps best understood with reference to the Figures, the main difference between applicator brush 50 and applicator brush 10 described above is in the configuration of the flexers. The flexer 54 includes a plurality of spaced apart ribs 60, each of which has an outer cylindrical surface 61. The sidewalls 62, 63 of the ribs 60 are concave curved surfaces between which grooves 65 are defined, adjacent curved sidewalls joining tangentially at a point 64 at the deepest point of groove 65. The flexer includes a core 55, which is an integral cylindrical shaped portion of the flexer underlying the ribs and their curved sidewalls. The core 55 extends beyond the outermost rib to form a tip 53 at the distal end of the applicator brush 50. The flexer 54 is relatively flexible because of the smaller diameter of the flexer core 55 vis-a-vis the rod 52 and because of the choice of materials for the flexer and rod, which may be as described above with respect to applicator brush 10.

The bristles 56 are applied to the flexer by the electrostatic flocking process, and bristles 57 align themselves generally perpendicular to the outer cylindrical surface of the ribs 60 and also generally perpendicularly from the concave sidewalls 62, 63 of the ribs wherein the bristles in the grooves 65 converge toward each other and provide a relatively dense bristle surface therein. The applicator brush 50 is also mounted on a cap of a cosmetics container (not shown) which has a wiper diaphragm disposed across the entry/exit passage.

The action of the wiper diaphragm with respect to the applicator brush 50 is similar to that described above for applicator brush 10, wherein the bristles 57 extending from the outer cylindrical surfaces 61 of the ribs 60 are wiped relatively clean whereas the bristles 58 in the grooves 65 tend to retain a substantial amount of mascara for application. The use of the applicator brush 50 is also similar to the use of brush 10 described above, with the bristles 58 in grooves 65 applying most of the mascara and the bristles 57 on the ribs 60 providing the combing action.

With reference to FIG. 8, another cosmetics applicator brush 70 according to the invention herein generally comprises a rod 72 mounting a ribbed flexer 74 having bristles 76 thereon. The ribbed flexer 74 includes a plurality of individual ribs 80 each of which, when viewed in section, tapers to a point 81. The ribs 80 each have diverging sidewalls 82 and 83 which, together with the sidewalls of adjacent ribs, form V-shaped grooves 85 between the ribs 80 converging to a bottom point 86. The core 75 of flexer 74 is the integral cylindrical portion underlying the ribs 80. As in the previous embodiments, the ribs 80 extend radially outwardly from an axis of the flexer, and are annular about that axis with the plane of the ribs being generally perpendicular to the axis of the flexer. The bristles 76 are attached by the electrostatic flocking process, which orients the bristles generally perpendicular to the surface of the flexer. Thus, in the grooves 85, the density of the bristles 77 is great and the bristles 77 criss-cross one another, wherein the bristles in the grooves are capable of carrying substantial amounts of mascara. The bristles 78 located near the points 81 of the ribs 80 extend outwardly from the flexer, and these bristles are vigorously wiped by the wiper diaphragm upon removal of the applicator brush 70 from an associated cosmetics container, whereby these bristles are relatively clean and available to perform the combing action of the applicator brush. The cosmetics applicator brush 70 does not have a protruding tip, but the outermost annular rib has its sidewalls tapering to a conical point 87 and the bristles located on this conical point carry a substantial amount of makeup and are available to perform a touch-up function, as desired.

The cosmetics applicator btushes of FIGS. 9–22 also generally comprise a rod, a ribbed flexer at one end of the rod and bristles secured to and extending outwardly from the flexer. The ribs of the various flexers shown in FIGS. 9–22 are sized and/or axially deployed to define contoured profiles which are also advantageous for applying mascara. The ords of the applicator brushes of FIGS. 9–22 are generally not shown, and it will be readily understood that a rod 15 described above as having its end 16 mounted to the cap of a cosmetics container and having its free end 17 mounting the flexers, is suitable.

With reference to FIG. 9, a flexer 100 of a cosmetics applicator brush is illustrated. The flexer 100 has a stem 101 for mounting the flexer to a rod, not shown. The flexer generally comprises a core 102, extending from the stem 101, and a plurality of annular ribs extending outwardly from the core at closely axially spaced-apart positions. The annular ribs first comprise a number of larger diameter discs 105 having an outer surface 106, and further comprise a number of smaller diameter discs 107, wherein the larger and smaller diamater ribs are deployed alternately along the core 102. Grooves 108 are defined between adjacent ribs, along the length of the flexer.

The flexer 100 further comprises a plurality of bristles 109 which are preferably attached to the flexer by an electrostatic flocking process, which orients the bristles generally perpendicularly to the surfaces of the flexer. The bristles are only shown over part of the flexer in FIG. 9, for clarity.

The cosmetics applicator brush including flexer 100 has a unique, three-level profile. The bristles attached to the larger diameter ribs also extend out the furthest from the core, are wiped somewhat vigorously upon removal from a container 90, and thus provide primarily a combing action. Bristles attached to the smaller diameter ribs form an intermediate level of the profile, and both carry product and comb. The bristles in the grooves form the low level of the profile, and serve primarily as product carriers.

With reference to FIG. 10, another cosmetics applicator brush 110 according to the invention also has a flocked flexer 111 mounted to a rod 15 via stem 112. The flexer 111 has rib configuration similar to that described in connection with flexer 20 above, and more particularly, the ribs are spaced apart along a core 113 of the flexer and extend radially outwardly therefrom, each rib having beveled diverging sidewalls and a substantial outer surface. However, the flexer 111 has larger diameter ribs 115 alternating with smaller diameter ribs 116, rather than ribs of uniform diameter. Grooves 117 are defined between the ribs, and the flexer is covered with bristles 119. It will be appreciated that the flexer profile has more widely spaced high points and more bristles extending from the larger ribs when compared to the profile of flexer 100 described immediately above, which enhances combing action, and yet provides substantial density and subordinate combing action between the high points from the smaller diameter ribs.

A flexer 120 of a cosmetics applicator brush is illustrated in FIGS. 11 and 12, and is characterized by having a "stepped" profile configuration created through axially offset ribs. The flexer 120 includes a stem 121 for attaching it to a rod 15, not shown, and a core 122. The ribs 125, 126 of the flexer 120 are all of the same diameter; however, the ribs 125, 126 are offset oppositely from the axis of the flexer. The end ribs 127 may have a large diameter so as to be coextensive with the outermost extension of the offset ribs. The ribs are separated by rounded grooved portions 128 of the core, and the entire flexer is covered with bristles 129.

As best seen in FIG. 11, the offset ribs provide alternative high/low profile along opposite sides of the flexer, to achieve spaced-apart high profile combing action, subordinate combing action from the lower ribs and large product carrying capability from the grooves. This is, of course, alternated on the opposite sides of a flexer. Additionally, and best seen in FIG. 12, the sides of the flexer present a more uniform profile, wherein the user has a choice of profiles within the same flexer structure.

FIG. 13 shows a flexer 130 for cosmetics applicator brush wherein the ribs of the flexer define a concave profile. More particularly, the flexer 140 comprises spaced-apart ribs 140–148 extending from a core 132. Rib 140, located at the outer end of the flexer and rib 148 located at the inner end of the flexer are the largest diameter ribs. Ribs 141 and 147 are incrementally smaller diameter than ribs 140 and 148. Similarly, ribs 142 and 146 are incrementally smaller than ribs 141, 147, and ribs 143, 145 are incrementally smaller than ribs 142 and 146. The central rib 144 is of the smallest diameter. The ribs are all spaced apart along the flexer and joined by rounded grooves 135, and the outermost surfaces of the ribs define a concave profile. This profile is present in the complete flexer including bristles 139, and the concave profile is adapted to complement the curve of eyelashes when applying mascara thereto, while retaining both good combing and product carrying capability.

Figure 14:
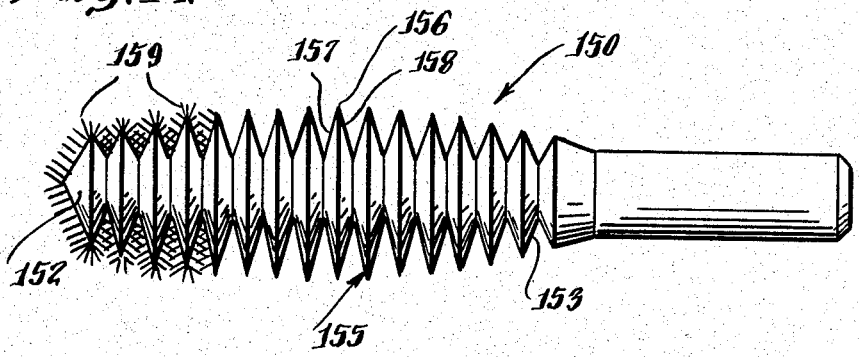
FIG. 14 is a side elevation view of a convex contoured flocked flexer for a cosmetics applicator brush according to the invention herein.

FIG. 14 illustrates a flexer 150 of a cosmetics applicator brush with a convex outer profile. The flexer 150 is comprised of a plurality of individual ribs, central rib 155, of the type having a point 156 and diverging sidewalls 157, 158. Thus, the sidewalls of adjacent ribs form a V-shaped groove therebetween. The individual ribs have diameters which vary incrementally from the diameter of adjacent ribs, with the central rib 155 having the largest diameter and the end ribs 152, 153 having the smallest diameter. Thus, the concave profile illustrated in the Figure is achieved. The flexer is, of course, flocked with bristles 159 for combing and product carrying action. The convex flocked profile of flexer 150 is especially well adapted for working in a confined space, such as in the corner of an eye.

Figure 15:
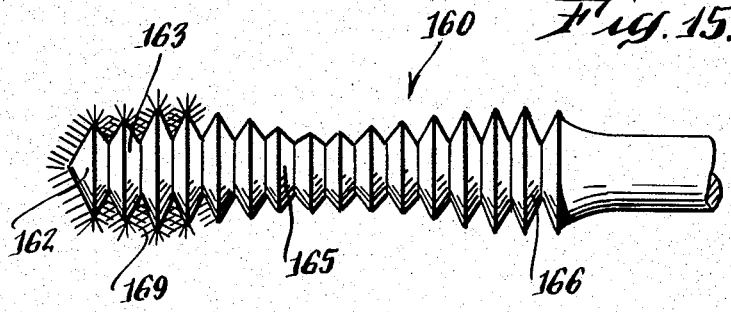
FIG. 15 is a side elevation view of a compound-curve contoured flocked flexer for a cosmetics applicator brush according to the invention herein.

Another cosmetics applicator brush has a flexer 160 illustrated in FIG. 15, which defines a compound convex and concave profile, achieving in one brush many of the advantages of the bruhes 130 and 150 described immediately above. More particularly, the flexer 160 has a central rib 165 of the smallest diameter, and the several ribs flanking the central rib 165 incrementally increase in diameter to define a concave profile between ribs 164 and 166. The two ribs 162, 163 positioned on the outer end of the flexer 160 from the rib 165 have incrementally smaller diameters from rib 165, thus defining a portion of the flexer with a convex profile for working in confined spaces near the eye. The flexer 160 is covered with bristles 169, and the combing action is achieved by the bristles extending the furthest from the flexer, those bristles also being the bristles secured to the flexer at or near the points of the individual ribs. The bristles which are located in the grooves of the flexer tend to provide the product carrying function of the brush applicator. The flexer 160, by virtue of its compound concave/convex profile, is highly adaptable to mascara application.

Figure 16:
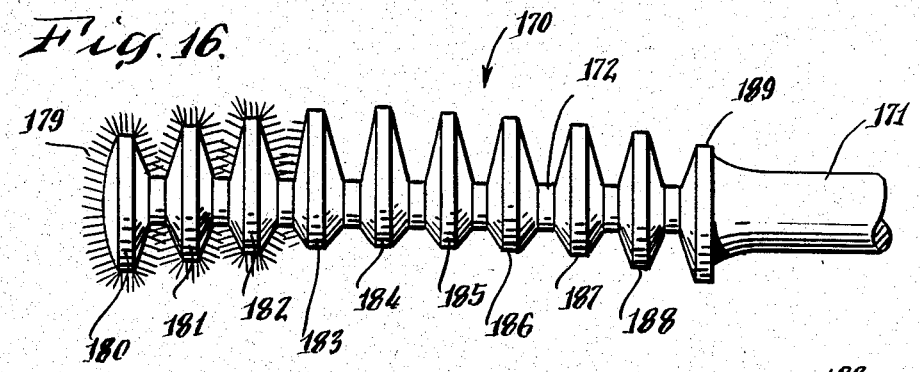
FIG. 16 is a side elevation view of an arch contoured flocked flexer for a cosmetics applicator brush according to the invention herein.
Figure 17:
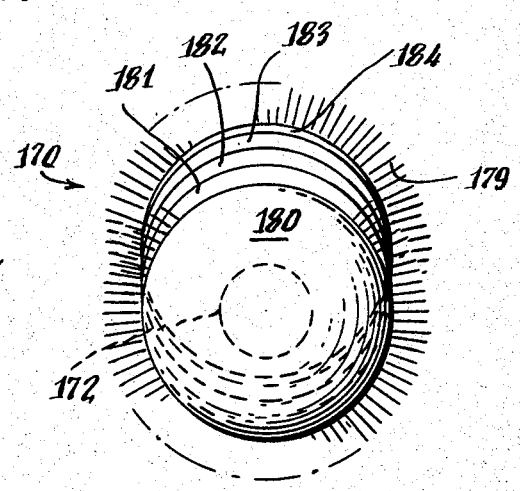
FIG. 17 is an end elevation view of the flexer of FIG. 16.

With reference to FIGS. 16 and 17 a cosmetics brush flexer 170 is shown in which the desired contoured profile, in this instance an arch, is achieved by "off axis" deployment of ribs. The flexer 170 includes a stem 171 for attachment to a rod, not shown, and a core 172 axially aligned with the stem 171 and rod. Ribs 180–189, in the form of annular discs, extend outwardly from the core 172; however, the individual ribs and the core are not all coaxial. In particular, the end rib 180 is coaxially with the core 172, and each succeeding adjacent rib 181–184 has its center furthest offset, and ribs 185–189 have their centers decreasingly incrementally offset from the rib 189 being coaxial with the core 172. As is apparent from the drawing, this arrangement of offset ribs provides an arched contoured profile of the flexer 170. The ribs are spaced apart on the core, wherein grooves are formed between the ribs, and bristles 179 are attached to the flexer, as in previously described cosmetics brushes. It will be appreciated that the arched shape is convenient for use with mascara applied to eyelashes.

Figure 19:
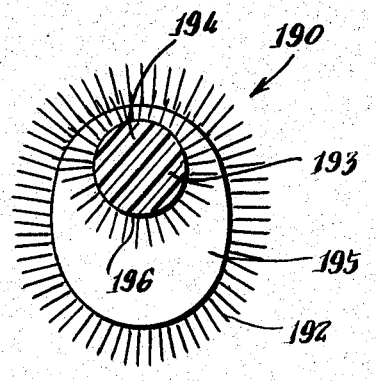
FIG. 19 is a sectional view of the asymmetric flocked flexer of FIG. 18, taken along the lines of 19—19 of FIG. 18.
Figure 18:
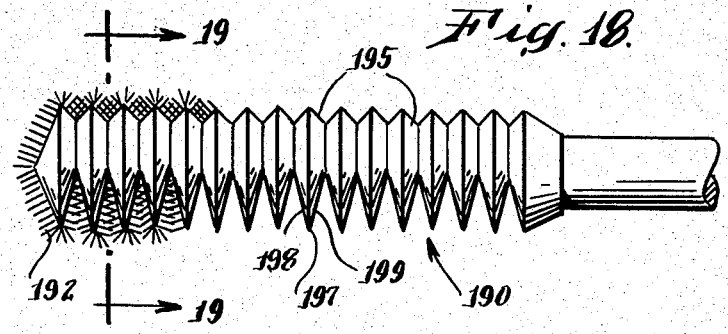
FIG. 18 is a side elevation view of an asymmetric flocked flexer for a cosmetics applicator brush according to the invention herein.

FIGS. 18 and 19 illustrate a flexer 190 of another cosmetics brush according to the invention herein which utilizes the feature of axially offset ribs to provide an asymmetric contoured profile. The flexer 190 comprises a plurality of ribs 195 extending outwardly from a core 193, as best seen in FIG. 19. As also best seen in FIG. 19, the ribs may have a somewhat oval shape when viewed in plan, and the centers of the ribs 195, indicated at 196, are offset from the axis of the core, indicated at 194. The ribs may be of the type having a point 197 with sidewalls 198, 199 diverging from that point, with adjacent sidewalls forming the grooves of the flexer. The flexer is covered with bristles 192 for product carrying and combing, as with the flexers described above.

The asymmetric flocked flexer 190 is highly versatile, in that it may be used from the lower side as shown in FIGS. 18 and 19, wherein the ribs and grooves therebetween are of substantial height, and may also be used from the upper side as shown in FIGS. 18 or 19, wherein the ribs and grooves have little or no height and the bristles are essentially the same as in a flat brush. For depths therebetween, the sides of the flexer, per the orientation in the FIG. 19, may be used. Thus, a single flexer provides a varying contour of rib depths about its longitudinal axis.

Figure 20:
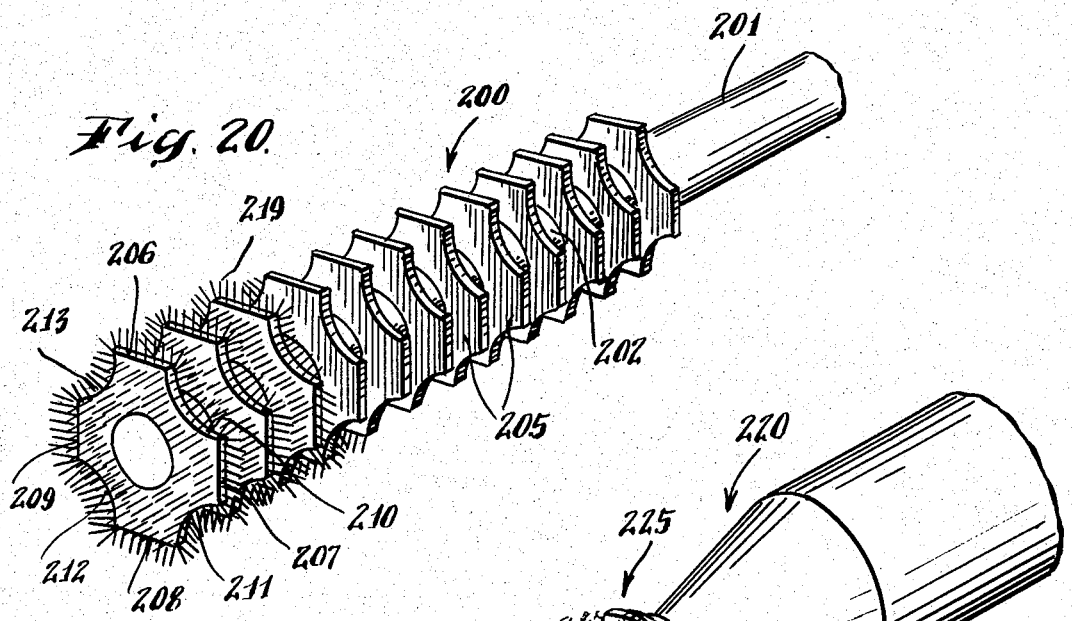
FIG. 20 is a perspective view of a contoured segment flocked flexer for a cosmetics brush according to the invention herein.

A flexer 200 is depicted in FIG. 20, the flexer 200 being characterized by having individually contoured ribs, thereby providing yet another cosmetics applicator brush according to the invention herein. The flexer 200 has a stem 201 and a core 202 coaxial therewith. Ribs 205 extend from the core at spacedapart intervals, and each of the ribs have a contoured profile when viewed in plan, or from the end of the flexer. The particular profile shown for the flexer 200 is a generally octagonal shape with the side edges of the octagon being alternately straight (edges 206–209) and concave (edges 210–213). The ribs are covered with bristles 219. The contoured ribs provide a different depth to the ribs and the grooves defined between the ribs depending upon the rotational orientation of the brush, whereby a single brush may again provide a range of product carrying combing capability.

Figure 21:
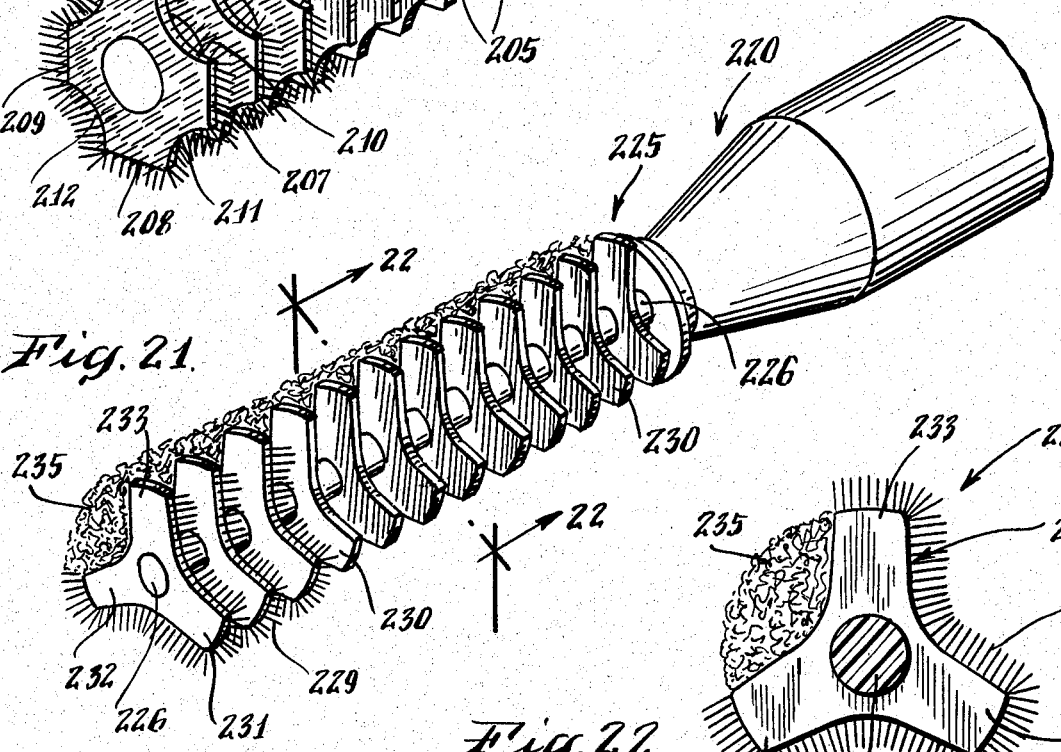
FIG. 21 is a perspective view of a contoured segment flocked flexer including an applicator pad, for a cosmetics brush according to the invention herein.
Figure 22:
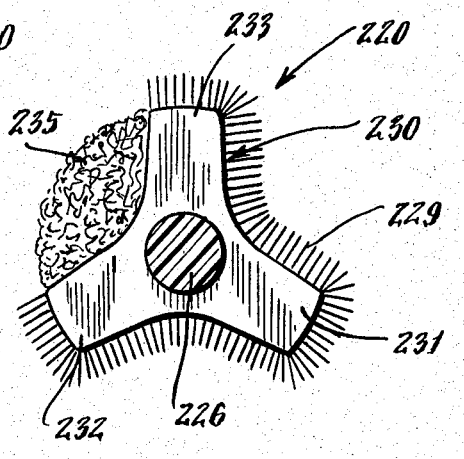
FIG. 22 is an end view of the flexer of FIG. 21.

FIGS. 21 and 22 illustrate another cosmetics applicator brush 220 according to the invention herein, wherein the flexer 225 is a composite flexer including both a contoured flocked rib portion and a cosmetics carrying pad portion. More particularly, brush 220 comprises a flexer 225 attached to a rod 221, with a core 226 of the flexer extending axially from the rod. A plurality of individual contoured ribs 230 are deployed spaced apart and extending outwardly from the core 222, in this instance the individually contoured ribs are in the form of a "Y", having three outwardly projecting legs 231–233. The ribs are aligned, wherein they form longitudinal notches between adjacent legs.

Attached between the outwardly extending legs 227 and 228 is a foam pad 235, which is capable of carrying a substantial amount of cosmetics. The remaining portions of the flexer, including the ribs and the core between the ribs are flocked with bristles 229 to provide a brush applicator portion of the flexer. It will be appreciated that the cosmetics applicator brush 220 using this composite flexer has a great deal of flexibility between the amount of the cosmetics product carried and selection of the desired amount of combing function.

It will be appreciated that other configurations of ribbed flexers may be provided according to the invention herein, for instance, the notched ribs mounting a foam pad can be incorporated into flexers having various contoured profiles. Variations in size and spacing from that shown is, of course, contemplated. These and other configurations of flexers which support bristles from protruding ribs and from grooves between the ribs such that passing the brush through a wiper results in some substantially clean bristles and some mascara carrying bristles results in the achievement of the objects of the invention herein. It will be appreciated that the size of the cosmetics applicator brush, including the length of the flexer, the size of the ribs and the spacing between the ribs, and the size and denier of the bristles are all selected with reference to the intended use of the cosmetics applicator brush, including the composition of the particular cosmetics product. Additionally, the flexer and rod can be made integrally if desired. Accordingly, various changes may be made in the preferred embodiments described above without departing from the spirit and scope of the invention, which is limited only by the following claims.

I claim:

1. A cosmetics applicator brush comprising:

(A) a rod;

(B) a flexer positioned at the end of the rod, the flexer having ribs extending outwardly from a core of the flexer with the ribs defining grooves therebetween, the ribs being sized, configured and deployed to provide a profile shaped with respect to the longitudinal axis of the flexer; and (C) bristles secured to the exterior of said ribbed flexer and extending outwardly therefrom, said bristles deployed on both of said rib and grooved portions.

2. A cosmetics applicator brush as defined in claim 1 wherein said flexer and rod are fabricated in separate pieces and said flexer is mounted to one end of said rod.

3. A cosmetics applicator brush as defined in claim 2 wherein said flexer has a stem portion received in an opening formed in the end of said rod.

4. A cosmetics applicator brush as defined in claim 2 wherein said rod is fabricated of a more rigid material than said flexer.

5. A cosmetics applicator brush as defined in claim 1 wherein the bristles are oriented substantially perpendicularly to the flexer surface to which they are attached.

6. A cosmetics applicator brush as defined in claim 5 wherein the bristles are all of approximately the same length, whereby those bristles secured to the ribbed portions of the flexer extend outwardly beyond those bristles secured in the grooved portion of the flexer.

7. A cosmetics applicator brush as defined in claim 1 wherein the ribs comprise a plurality of annular ribs of a first, larger diameter and a plurality of annular ribs of a second, smaller diameter with ribs of the larger and smaller diameters being deployed alternately along the length of the flexer, whereby the flexer has a stepped high/low profile.

8. A cosmetics applicator brush as defined in claim 7 wherein the bristles are all of approximately the same length, whereby those bristles secured to the ribs of the flexer extend outwardly beyond those bristles secured in the grooves of the flexer.

9. A cosmetics applicator brush as defined in claim 8 wherein the annular ribs have outer cylindrical surfaces, whereby the ribs support a substantial number of bristles extending outwardly therefrom.

10. A cosmetics applicator brush as defined in claim 1 wherein the ribs comprise a plurality of annular ribs having their centers on the longitudinal axis of the flexer wherein adjacent ribs have incrementally varying diameters to define a shaped profile of the flexer.

11. A cosmetics applicator brush as defined in claim 10 wherein the largest diameter ribs are at the outer and inner ends of the flexer and the smallest diameter rib is approximately midway therebetween, whereby the flexer defines a concave profile.

12. A cosmetics applicator brush as defined in claim 11 wherein the annular ribs have sidewalls which converge and join at the outside circumference of said ribs, the sidewalls of adjacent ribs converging together to define V-shaped grooves between said ribs, and the bristles are all of approximately the same length, whereby those bristles secured to the ribs of the flexer extend outwardly beyond those bristles secured in the adjacent grooves of the flexer.

13. A cosmetics applicator brush as defined in claim 10 wherein the smallest diameter ribs are at the outer and inner ends of the flexer and the largest diameter ribs is approximately midway therebetween, whereby the flexer defines a convex profile.

14. A cosmetics applicator brush as defined in claim 13 wherein the annular ribs have sidewalls which converge and join at the outside circumference of said ribs, the sidewalls of adjacent ribs converging together to define V-shaped grooves between said ribs, and the bristles are all of approximately the same length, whereby those bristles secured to the ribs of the flexer extend outwardly beyond those bristles secured in the adjacent grooves of the flexer.

15. A cosmetics applicator brush as defined in claim 10 wherein the largest diameter ribs are at the inner end and near the outer end of the flexer and the diameters of the ribs therebetween incrementally vary to define a concave profile, and the diameters of the ribs between the largest diameter rib near the end of the flexer and the rib at the end of the flexer incrementally decrease to define a partial conves profile, whereby the flexer has a compound concave/convex profile.

16. A cosmetics applicator brush as defined in claim 15 wherein the annular ribs have sidewalls which converge and join at the outside circumference of said ribs, the sidewalls of adjacent ribs converging together to define V-shaped grooves between said ribs, and the bristles are all of approximately the same length, whereby those bristles secured to the ribs of the flexer extend outwardly beyond those bristles secured in the adjacent grooves of the flexer.

17. A cosmetics applicator brush as defned in claim 1 wherein the ribs are generally annular and at least some of the ribs have their centers offset from the axis of the flexer, whereby the ribs define a shaped profile of the flexer.

18. A cosmetics applicator brush as defined in claim 17 wherein adjacent ribs have their centers oppositely offset from the flexer in a plane, whereby the flexer ribs define a high/low profile in that plane and define a relatively smooth profile perpendicular to that plane.

19. A cosmetics applicator as defined in claim 17 wherein adjacent ribs have their centers offset from the axis of the flexer by incrementally varying amounts and the rib centers are in a plane, such that the ribs define an arched flexer profile.

20. A cosmetics applicator brush as defined in claim 17 wherein the rib centers are deployed along an axis offset and aligned with the flexer axis, whereby the grooves between the ribs are of varying depth about the flexer.

21. A cosmetics applicator brush as defined in claim 1 wherein the ribs, when viewed in plan, are contoured and the ribs are aligned, whereby the flexer defines the profile of the aligned contoured ribs.

22. A cosmetics applicator brush as defined in claim 21 wherein the rib contours define a longitudinal notch and the cosmetics applicator brush further comprises a cosmetics carrying pad mounted in said notch.

23. A cosmetics applicator brush as defined in claim 22 wherein the pad is fabricated of porous flexible plastic foam.

24. A cosmetics applicator brush as defined in claim 1 wherein ribs define a longitudinal notch along at least part of the length of the flexer, and the cosmetics applicator brush further comprises a cosmetics carrying pad mounted in said notch.

25. A cosmetics applicator brush as defined in claim 24 wherein the pad is fabricated of porous flexible plastic foam.

* * * * *